United States Patent [19]

Wilkinson et al.

[11] Patent Number: 4,711,061

[45] Date of Patent: Dec. 8, 1987

[54] ROOF AND A METHOD OF PROVIDING A BUILDING WITH A ROOF

[75] Inventors: John Wilkinson, Dursley; Nicholas Holbrook, Camberley, both of United Kingdom

[73] Assignees: Jacqueline M. Ashfield; Michele Ashfield, both of Bristol, United Kingdom

[21] Appl. No.: 799,431

[22] Filed: Nov. 19, 1985

[30] Foreign Application Priority Data

Nov. 19, 1984 [GB] United Kingdom ..... 8429194
Aug. 14, 1985 [GB] United Kingdom ..... 8520339

[51] Int. Cl.[4] ..... E04B 7/00; E04B 1/66

[52] U.S. Cl. ..... 52/410; 52/22; 52/309.4; 52/417; 52/419; 52/515

[58] Field of Search ..... 52/3, 12, 23, 309.4, 52/417, 419, 410, 515

[56] References Cited

U.S. PATENT DOCUMENTS

| | | | |
|---|---|---|---|
| 2,068,098 | 1/1937 | Elmendorf | 52/417 X |
| 2,150,217 | 3/1939 | Gettelman | 52/22 X |
| 2,306,537 | 12/1942 | Hamm | 52/3 X |
| 2,923,305 | 2/1960 | Cline | 52/459 X |
| 3,121,977 | 2/1964 | Bersudsky | 52/417 X |
| 3,716,958 | 2/1973 | Scrivener | 52/713 |
| 4,320,605 | 3/1982 | Carlson et al. | 52/309.4 X |
| 4,519,175 | 5/1985 | Resan | 52/747 X |
| 4,616,455 | 10/1986 | Hewison | 52/410 X |

FOREIGN PATENT DOCUMENTS

| | | | |
|---|---|---|---|
| 19892 | 12/1980 | European Pat. Off. | 52/410 |

*Primary Examiner*—Alfred C. Perham
*Attorney, Agent, or Firm*—Arnold S. Weintraub

[57] ABSTRACT

A roof, or a portion of a roof, resiliently securable to a sub-structure (4) of a building, the roof or roof portion comprising:

a panel (1);

a strip (2) which is overlapped by and supports the panel (1) on at least a portion of the edge regions (3) thereof; and an intermediate layer (10) of a resilient sealing material which spaces the panel (1) from the strip (2) such that the panel (1) is capable of relative movement with respect to the strip (2) while sealing the panel (1) with respect to the strip (2).

A method of providing a building with such a roof is also disclosed.

5 Claims, 12 Drawing Figures

ROOF AND A METHOD OF PROVIDING A BUILDING WITH A ROOF

This invention relates to a roof and a method of providing a building with a roof, and is more particularly, although not exclusively, concerned with a roof formed from a single panel which panel is capable of relative movement with respect to a sub-structure of the building, and also with a roof formed from a plurality of panels which are resiliently secured together such that the panels are capable of relative movement with respect to each other and with respect to the substructure of the building.

Fibreglass, in association with a solid board, has also been used as a roofing material as follows. A solid board is sold with instructions for coating the solid board with a layer of fibreglass material; thus, fibreglass matting is placed on the board and this is formed into a solid sheet of fibreglass by the use of a resin and a suitable catalyst. The layer of fibreglass material formed is continuously bonded to the solid board with the intention of creating a waterproof panel.

The panels created may be used in the construction of a roof. These panels, which represent a layer of fibreglass material directly bonded to a board, suffer from the disadvantage which arises because of the different coefficients of expansion of the solid board and of the layer of fibreglass. Thus, the fibreglass or the board is likely to crack or blister under extremes of temperature.

Another type of roofing material which is commonly employed is felt. Felt roofs, however, suffer from a number of disadvantages, including the presence of small holes caused when the felt is tacked to the substructure of the roof; the small holes may allow water to leak through the roof. To overcome this problem several layers of felt need to be used, thereby substantially increasing the cost of the roof, Further, the nature of the felt layer prevents any circulation of air within the roof itself and, as a result, moisture may build up giving rise to problems of rot.

The use of glass-reinforced-plastics for constructing a roof of a building, particularly a flat building is known from GB No. 2078277A. This roof is rigid and allows no relative movement of the panels of the roof.

Another example of a roof system is disclosed in GB No. 2061350A.

Roofs constructed from other materials, such as corrugated iron, are also well known and techniques by which such roofs may be allowed to move relative to the sub-structure of the buildings to which they are attached are known. For example, British Patent Specification No. 1553876 discloses a clip which permits side to side movement of the panels of the roof whilst the clip of British Patent Specification No. 1543290 permits up and down movement of the panels of the roof. The clips are rigid metal articles and the construction of a roof using such clips is time consuming.

According to one aspect of the present invention, there is provided a roof, or a portion of a roof, resiliently securable to a sub-structure of a building, the roof or roof portion comprising:

a panel;

a strip which is overlapped by and supports the panel along at least a portion of the edge regions thereof;

respective fixing means, each extending through a respective aperture in the panel and a corresponding respective aperture in the strip to secure the roof, or the roof portion, to the sub-structure of the building whilst permitting relative movement between the panel, strip and sub-structure; and an intermediate layer of a resilient sealing material which spaces the panel from the strip such that the panel is capable of relative movement with respect to the strip whilst sealing the panel with respect to the strip, the resilient sealing material being chosen from those materials which are liquid before assembly of the roof and which are capable of setting, after assembly of the roof, to provide the intermediate layer.

The strip serves a dual function. Thus, the strip acts to support the panel along its edge regions, providing a basis about which the panel may flex by virtue of the intermediate layer of the resilient material. The strip also serves to hold the panel above the sub-structure of the building such that air may circulate under the panel.

In preferred embodiments of the present invention, the roof or roof portion comprises:

an array of said panels, each panel being resiliently secured to an adjacent panel of the array along their adjacent edge regions;

at least one strip which is overlapped by, and is fixed to, said adjacent edge regions to secure the adjacent panels together;

a plurality of fixing means, each extending through a respective aperture in the panel and a corresponding respective aperture in the strip to secure the roof, or the roof portion, to the sub-structure of the building whilst permitting relative movement between the panels, the at least one strip and sub-structure;

wherein the at least one strip, the edge regions of the panels which overlap the at least one strip, and adjacent edges of the panel are spaced-apart by an intermediate layer of a resilient sealing material, the resilient sealing material being chosen from those materials which are liquid before assembly of the roof and which are capable of setting, after assembly of the roof, to provide the intermediate layer; and wherein the panels are capable of relative movement with respect to each other and with respect to the at least one strip, whilst a seal is provided between those components between which there may be relative movement.

Each panel of the array can, in effect, move slightly in all directions. Thus, whereas wind can have a drastic effect on prior art roofs, the present roof is capable of moving slightly in response to the wind or any other external influence on the roof. Thus, the lifetime of the roof of the present invention is considerably increased over prior art roofs because the amount of wear and tear is reduced by virtue of the panel, or panels, of the array being capable of moving slightly.

Preferably, the strips are disposed between the array of panels and the sub-structure of the building and, in a preferred embodiment, the periphery of the array is supported and overlapped by a further strip or strips via which the panels are resiliently securable to the substructure. Again, the further strip is spaced apart from the peripheral region of the array by an intermediate layer of the resilient material which allows a degree of relative movement between the panel and the strip.

The roof is resiliently secured to the sub-structure of the building by a fixing means which extends through an aperture in the edge region of the panel and an aperture in the strip, and which is fixed to the sub-structure, whilst allowing said relative movement. The fixing means may be, for example, a screw, a bolt, or a pin which extends through the said apertures. Conveniently, a sleeve, preferably made of nylon, is provided between the aperture of the panel and the aperture of the strip and the fixing means passes through the sleeve. The fixing means may comprise a head which has a diameter greater than the diameter of the aperture in the panel such that the head holds the panel down. Conveniently, the outer diameter of the screw is less than the inner diameter of the sleeve and the outer diameter of the sleeve is preferably less than the inner diameter of the apertures, such that there are spaces between the apertures, sleeve and fixing means. The spaces are preferably filled with the resilient material.

The resilient material is preferably a rubber sealant. The rubber sealant is a liquid prior to assembly of the roof, which liquid sets to a solid form after assembly of the roof. One such, presently preferred, rubber sealant is a material known by the Registered Trade Mark SIKAFLEX.

The panel or panels of the roof may be made of fibreglass. However, the construction of the roof is not to be limited to such a material as many other materials may be used, for example a glass reinforced plastic, other plastics materials, metal or any other suitable rigid or semi-rigid material.

The roof may be constructed as a "warm roof" in which case an insulating layer is provided between the at least one strip and the sub-structure of the building. The insulating layer is preferably a closed cell foam but may be any other form of insulating material.

The roof of the present invention is generally formed of a single, large panel which large panel is formed of a number of smaller panels joined at their edge regions. One advantage of the roof is that it can be constructed in situ. Although, as mentioned above, the roof may be formed of a number of panels, it is to be appreciated that the roof may comprise a single panel which is resiliently fixed to strips and to a sub-structure of the building along its outer periphery such that the panel is capable of relative movement with respect to the strips and with respect to the sub-structure of the building.

The roof may be constructed to co-operate with other features of the roof. Thus, for example, where a drain pipe, a flue, a sky light or vent protrudes through the roof, the roof may be designed to accommodate this feature with the feature being sealed into the roof by provision of a hole in a panel of the roof or between adjacent panels of the roof, through which hole the feature extends. Around the aperture is preferably placed, to support the edge regions of the panel forming the aperture, a strip, the strip and the edge regions of the aperture being spaced apart by an intermediate layer of the resilient material. The edge region of the panel around the aperture is preferably fixed to the substructure of the building by virtue of fixing means extending through holes in the panel and the strip as hereinbefore described. The gap between the feature and the panel and strip may be filled with the rubber sealant.

The roof of the present invention may be applied to flat, domed or low pitched roof structures. Furthermore, the roof may be coated with a layer of polyester flow coating to further seal and waterproof the roof. The roof may be installed in wet conditions. By the use of a fireproof insulator, the roof may be constructed to fire safety standards.

In accordance with a second aspect of the present invention, there is provided a method of roofing a building, which method comprses positioning at least one strip above a sub-structure of the building; providing a liquid sealing material on the at least one strip; disposing a panel over the sealing material on the at least one strip; securing the panel and the at least one strip to the sub-structure of the building by a fixing means which extends through an apertures in the panel and a corresponding aperture in the at least one strip to secure the roof or roof portion to the sub-structure of the building whilst permitting relative movement between the panel and the at least one strip and the sub-structure; and permitting the liquid sealing material to set, thus providing an intermediate resilient layer between the panel and the at least one strip.

In one embodiment of this method, an array of panels are disposed over at least one strip such that adjacent edge regions of adjacent panels overlap the at least one strip; the method further comprising the step of providing a resilient sealing material between the adjacent edges of the panels. As a final step in the aforementioned method, the panel, or each panel, may be coated on its weather side with a waterproof gel coating.

As can be appreciated, the method of the present invention allows a roof to be rapidly and efficiently constructed in situ, with sheets of the material from which the panel or panels are constructed being formed at a work shop away from the location of the building to be roofed.

A presently preferred size of sheet is 8×4 ft. (2.5×1.25 m). Such sheets are approximately 2 mm in thickness. The strips are preferably constructed in lengths which are about 1 ft. (300 mm) wide, again constructed as a 2 mm thickness. The apertures in the edge regions of the panels and in the strips through which the fixing means extend are conveniently drilled at 2 ft. (600 mm) intervals, approximately 3 inches (75 mm) from the edge of the panel or strip.

The roof, or roof portion, of the first aspect of this invention may further include at least one elastic restraining means inward of the periphery of one or more or all of the panels and connecting the sub-structure and the panel.

According to a third aspect of the present invention there is provided a roof, or a portion of a roof, of a building, the roof or roof portion comprising :

a sub-structure, and, above the support structure, a panel of a rigid or semi-rigid material, wherein the panel is secured at intervals along its periphery and is capable of relative movement with respect to the sub-structure by the provision of an elastic restraining means inward of the periphery panel which restraining means connects the sub-structure and the panel.

The panel of fibreglass material, not being rigidly fixed to the sub-structure inward of the periphery of the panel, may expand in warm weather causing the panel as a whole to form a shallow dome. The doming of the panel causes air to be drawn into the space between the sub-structure and the panel, through gaps around the periphery of the panel, and possibly also through the layer immediately below the panel. The circulation of air caused by the aforementioned movement of the fibreglass panel serves to prevent any build up of moisture, through condensation, in the space between the panel and the sub-structure.

The panel of fibreglass material may be secured, at intervals along its periphery, to the sub-structure by means of bolts, tacks or other convenient means. Additionally, the panel may be provided, at its periphery, with a rim, a downwardly extending portion of the rim being secured to the sub-structure. Furthermore, a lip may be provided along at least a portion of the periphery of the panel to extend under existing flashing of the building.

The panel of fibreglass material may be constructed to cooperate with other features of the roof. Thus, for example, where a drainpipe, a flue or an air inlet of the building protrude through the roof, the panel of fibreglass may be designed to accommodate this feature with the feature being sealed into the roof by the use of a shaped piece of fibreglass matting, a resin and a suitable catalyst whereby the feature is bonded to the main panel of fibreglass material.

In a preferred embodiment of this aspect of the present invention, the roof further comprises an insulating layer between the panel of fibreglass material and the sub-structure. The insulating layer may comprise a plurality of spaced apart insulating boards which may be manufactured from a composite material which material allows air to permeate therethrough. The insulating boards may be arranged on the sub-structure with approximately 6mm gaps between the insulating boards. The gaps allow the circulation of air in the spaces between the panel of fibreglass and the sub-structure. In this embodiment, the panel of fibreglass material lies directly above the layer of insulating material and may move away from this layer as the panel of fibreglass expands during hot weather.

It is to be appreciated that very large roof areas may be covered by a single, unitary panel of fibreglass material. This single, unitary panel of fibreglass material may be formed from a plurality of sheets bonded together at adjacent edge regions. This bonding may be effected in situ.

Where the panel of fibreglass is relatively large, then as the fibreglass expands on heating the panel will form a dome. The larger the panel of fibreglass is, the higher the dome will extend. In order to prevent the formation of a large dome on such a roof, the roof may also include at least one elastic restraining means, inward of the periphery of the panel, connecting the sub-structure and the panel of fibreglass material, but nonetheless permitting relative movement between the panel and the sub-structure. The restraining means may be fixed to the panel of fibreglass material by means of a eye which is fixed to a steel plate cast into the panel of fibreglass material. Attachment to the sub-structure may be by means of a ring bolt which is bolted through the sub-structure or screwed into the sub-structure. Conveniently, the restraining means is formed of a rubber material.

The panel of fibreglass material may be provided, on the weather side thereof, with a coat of a waterproof gel.

The roof, or portion of roof, according to the present invention may be a flat, or slightly sloped, roof in which case the entire roof may be covered by a single, unitary flat piece of fibreglass material. For a pitched roof of conventional construction, a single panel of fibreglass may be used to cover each separate sloping face of the roof, with each panel being joined at the ridges of the roof with fibreglass matting, resin and a suitable catalyst.

In accordance with a fourth aspect of the present invention, there is provided a method of roofing a building, which method comprises positioning a panel of fibreglass material above a sub-structure, and securing the panel of fibreglass material at its periphery, whilst leaving provision for relative movement between the panel and the sub-structure.

The panel of fibreglass may conveniently be of a unitary nature in which case the panel may be formed from a plurality of fibreglass sheets bonded together at adjacent edge regions. The fibreglass sheets may be bonded together with fibreglass matting, a resin and a suitable catalyst.

As a final step in the aforementioned method, the panel of fibreglass may be coated on its weather side with a waterproof gel coating.

As can be appreciated, the method of the present invention allows a roof to be rapidly and efficiently constructed in situ, with sheets of fibreglass material of a standard size being constructed at a workshop removed from the building to be roofed. A presently preferred size of fibreglass sheet is 8×4 ft. (2.5×1.25 m). Such sheets are transported to the building where they are placed on top of the sub-structure or, if an insulating layer is to be included, over the insulating layer, and bonded together with fibreglass matting resin and a suitable catalyst. On a flat roof, for example, a fibreglass rim may be bonded to the periphery of the panel of fibreglass, with a downwardly extending portion of the rim being secured to the sub-structure. A gel coating may then be applied to weatherproof the entire roof.

Reference will now be made, by way of example only, to the accompanying drawings in which.

Figure 1:
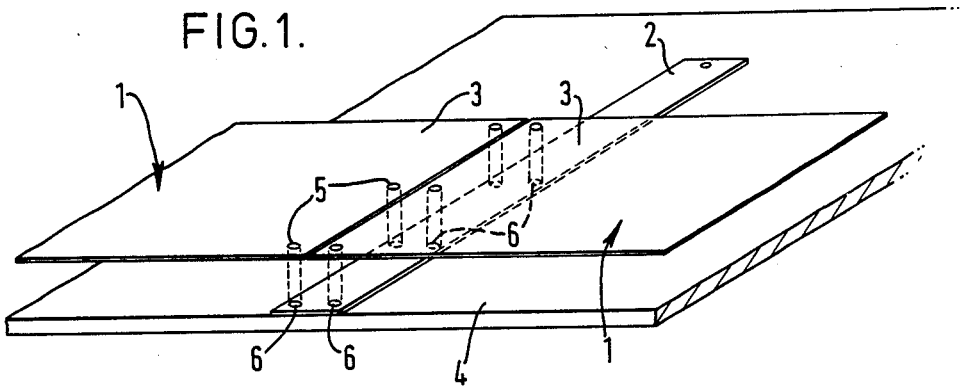
FIG. 1 shows the mode of construction of one embodiment of roof of the present invention.

With reference to FIG. 1, a prospective view of part of a roof according to the present invention is shown. Two panels 1 are fixed to a strip 2 which overlaps the edge regions 3 of the panels 1. The strip 2 is disposed above a sub-structure 4 of a building to which the roof is applied.

Figure 2:
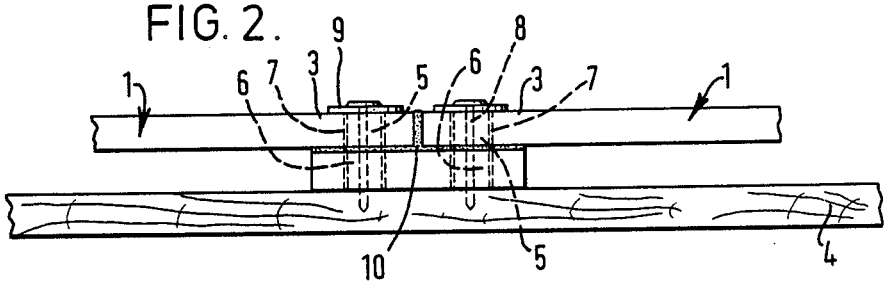
FIG. 2 shows a section through a part of a roof according to the present invention.

The panels 1 are provided in their edge regions 3 with apertures 5 which align with apertures 6 in the strip 2. With reference now to FIG. 2 in association with FIG.

1; the panels 1 having edge regions 3 are again shown. Through the apertures 5, 6, is placed a nylon sleeve 7 and through the hole defined by the sleeve 7 is passed a fixing means 8, for example a screw. The upper end of the screw is provided with a washer 9 which overlaps the panel around the aperture 5 to support the fixing means which holds the panels 1 to the strip 2 and subsequently to the sub-structure 4 of the building. An intermediate layer 10 is provided in the space between each panel 1 and between the edge regions 3 of the panels 1 and the strip 2. The intermediate layer 10 of a resilient material permits the panels 1 to flex relative to each other and relative to the strip 2.

An entire roof may be constructed from an array of such panels 1 and, if this is desired, the roof is constructed by initially laying down an arrangement of strips as shown in FIG. 2. The bold lines show the strips 2 and the dotted lines show the position of panels (not shown) positioned over the strips 2. The apertures 6 in the strip are shown. In preferred embodiments, these apertures will be at approximately 2 ft. (600 mm) intervals. Along the periphery of the arrangement, the panel (not shown) will not abut other panels. At the periphery, the panels (not shown) are secured resiliently to the strip 2 defining the periphery of the arrangement of strips and that peripheral strip is secured to the substructure of a building.

Figure 4:
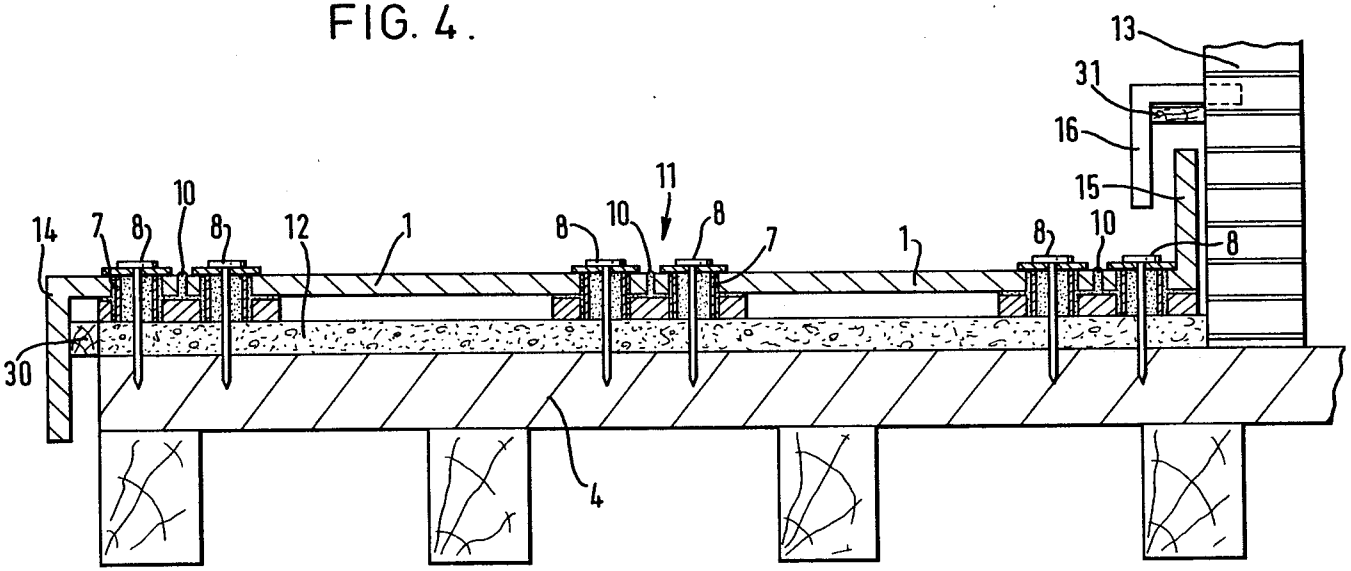
FIG. 4 shows a section through another roof of the present invention.

With regard to FIG. 4, the section of a roof comprises panels 1 which are secured together at the position indicated by reference numeral 11 in a manner similar to that shown in FIG. 2. However, this embodiment of the present invention additionally comprises an insulating layer 12 through which the fixing means 8 must pass before being secured to the sub-structure 4 of the building. The insulating layer is preferably of a closed cell foam material.

At the periphery of the roof and, for example, adjacent to a wall as shown with reference 13, the roof is secured in a manner similar to that shown in FIG. 2. Thus, the overhanging detail 14 may be considered as a panel, the overhanging portion 14 being secured to the adjacent panel 1 as shown in FIG. 2. Similarly, the arrangement shown for securing the roof to the wall 13 comprises an L-shaped section which is adjacent a panel, the L-shaped section 15 being resiliently secured to the adjacent panel 1 in a manner as shown in FIG. 2. The overhanging flashing 16 protects the L-shaped portion 15 whilst allowing air to enter freely the space between the insulating layer 12 and the panels 1. Treated battens 30 and 31 serve to support the sections 14 and 16 respectively. The gap between the panel and the insulating layer is equal to the height of the strip and is preferably about 2mm. In the cold roof application shown in FIG. 2, the sub-structure or decking 4 may be covered with a membrane which seals the decking or sub-structure 4.

Figure 5:
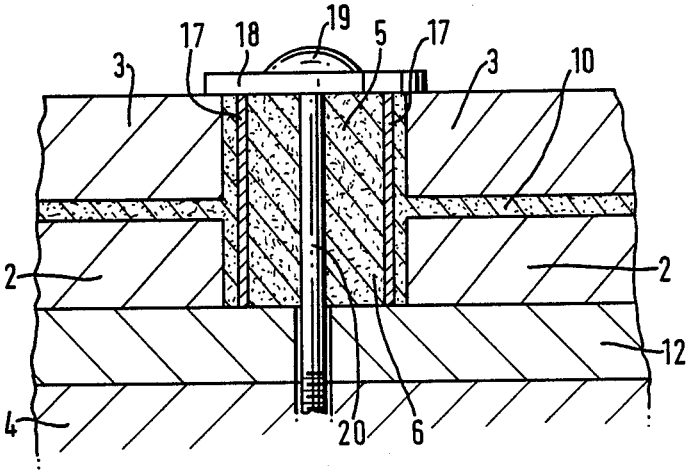
FIG. 5 shows in close detail the mode of fixing together of the panels of a roof according to the present invention.
Figure 3:
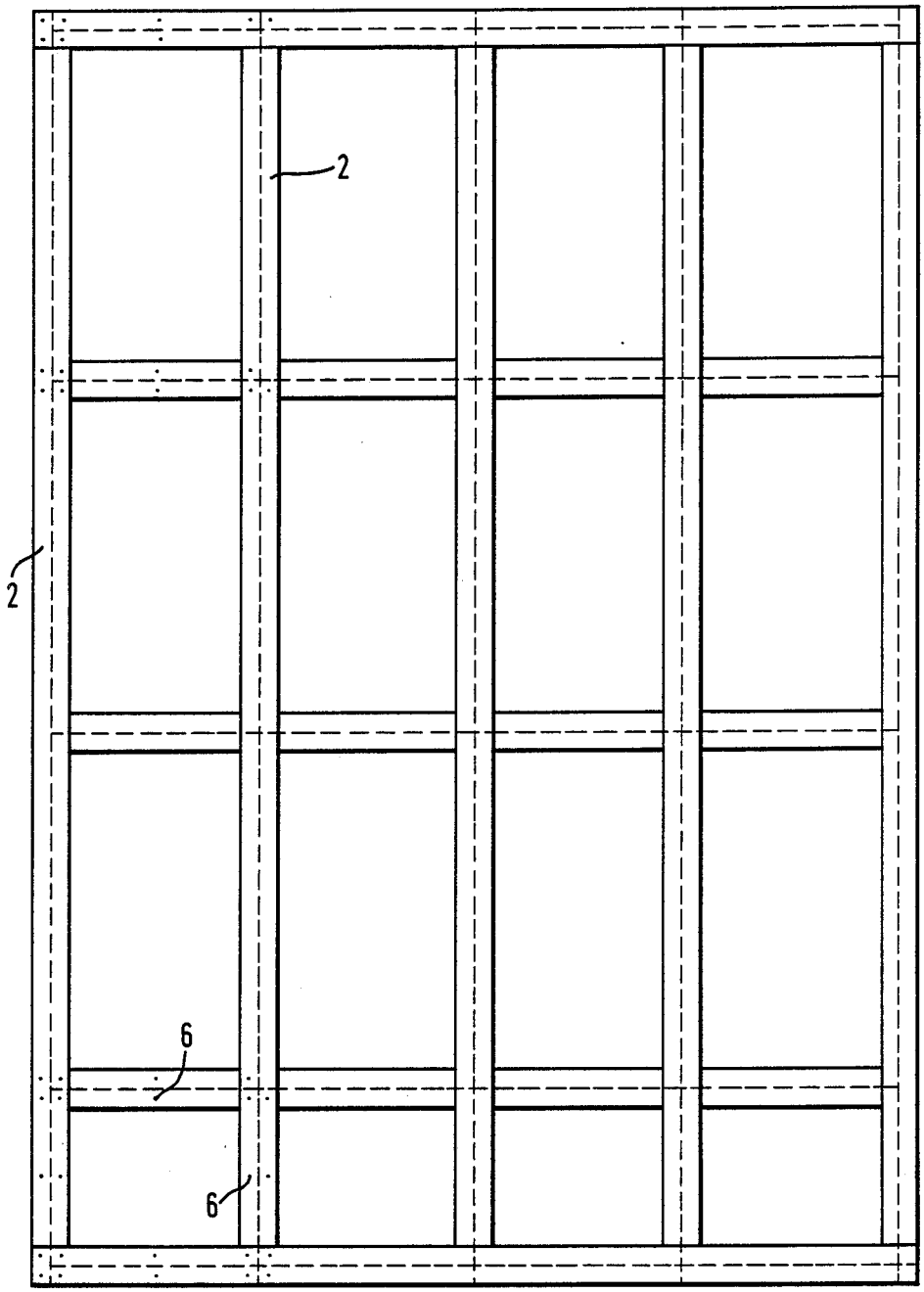
FIG. 3 shows the arrangement of the strips for a roof according to the present invention.

In FIG. 5, a closer detail of the means by which two adjacent panels are fixed together is shown. The edge regions of three of the panels overlap the strip 2 which, in a "cold roof" application, is positioned above the decking 4 of a building which is being roofed. The apertures 5 and 6 define a passage in which a sleeve 17 sits. The outside diameter of the sleeve 17 is less than the internal diameter of the apertures 5, 6. A washer 18 overlies the aperture 5 and supports the head 19 of the fixing means, for example a screw 20. The outer diameter of the fixing means 20 is less than the inner diameter of the sleeve 17. The spaces between the panels 3 and the strip 2 and the spaces in the apertures are filled with the resilient sealing material 10 which is preferably a rubber sealing material, for example that sealing material known by the Registered Trade Mark SIKAFLEX.

When the joint is constructed, the strip is laid down, and preferably tacked, to the decking of the building to be roofed. A layer of the liquid resilient sealing material is applied over the strip and the panel is then positioned above the strip 2 such that pre-drilled apertures 5, 6 overlap. The sleeve 17 is placed through the apertures 5, 6 and the fixing means 20 is passed through the sleeve, through the layer of insulating material 12 and into the decking 4. The action of screwing the panel to the strip squeezes the liquid resilient sealing material 10 into all the empty spaces around the sleeve and fixing means. Further liquid resilient sealing material may be applied over the head of the fixing means once the panel 3 and strip 2 have been screwed down.

Figure 6:
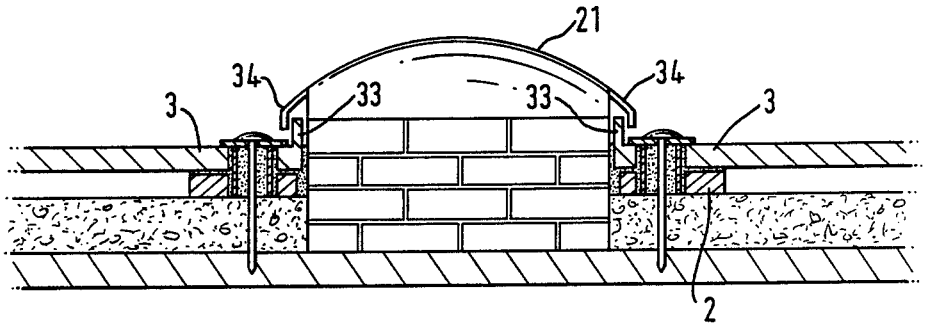
FIG. 6 shows a section through a roof according to the present invention, the roof cooperating with a sky light protruding through the roof.
Figure 7:
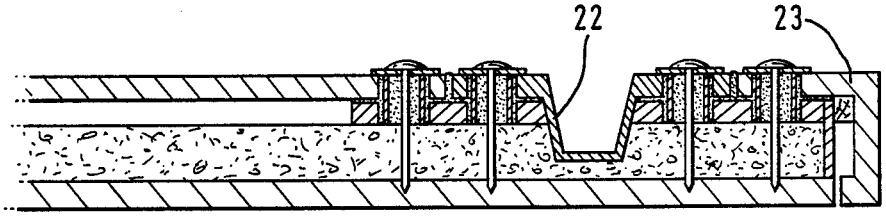
FIG. 7 shows a section through the end of a roof according to the present invention.

FIGS. 6 to 9 show how the roof of the present invention may be adapted to cooperate with existing features of a roof. In FIG. 6, the roof cooperates with a sky light 21. The panels are pre-formed such that when positioned during construction the panels abut the sky light. Under the edge regions 3 of the panels is laid a strip 2 to which the panel 3 is secured in a manner as described with reference to FIG. 2. Resilient sealing material is provided around the sky light to seal the skylight. The panels 3 have upturns 33 which lie below overlapping portions 34 of the skylight, there being a passage therebetween for the movement of air. In FIG. 7, a valley gutter 22 is secured in position as if it were a panel as described above. The overhanging drip off flashing 23 can also be considered as another panel which is fixed to the valley guttering in a manner as described above.

Figure 8:
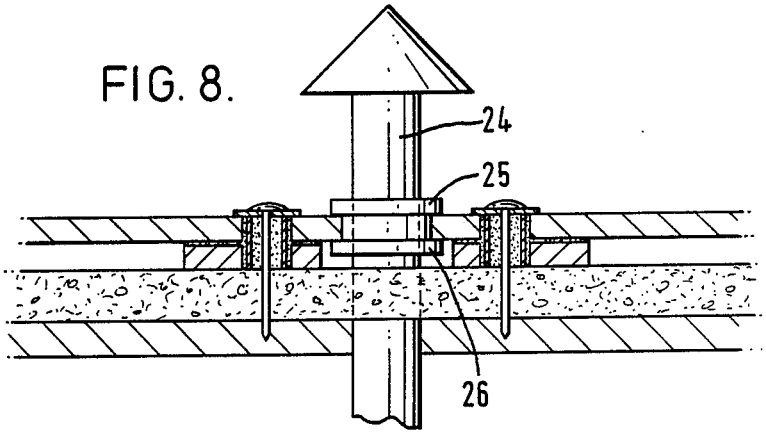
FIG. 8 shows a section through a roof of the present invention cooperating with a vent.

With regard to FIG. 8, a flue 24 is accommodated in the roof. A rubber collar 25 having a groove 26 which cooperates with the edge of the panel surrounding the flue seals the flue 24 in the roof.

Figure 9:
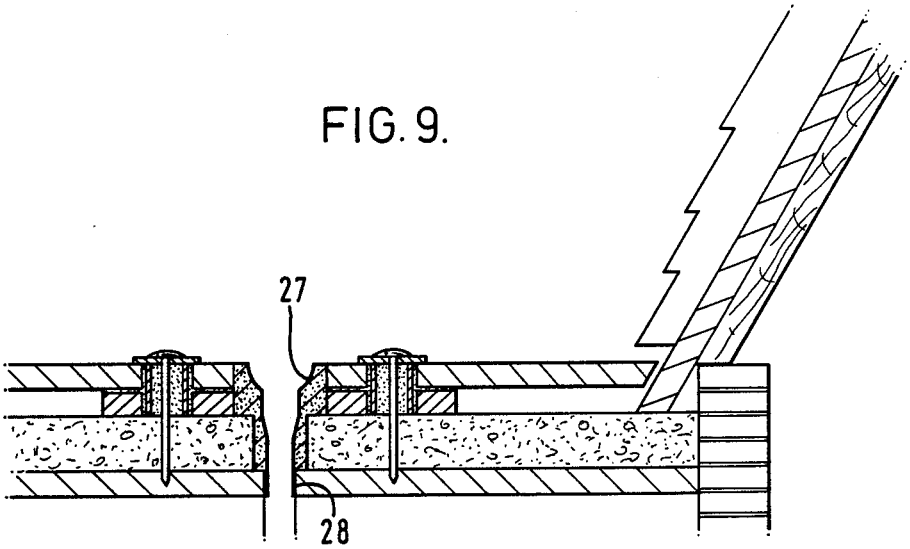
FIG. 9 shows a section through a roof according to the present invention, cooperating with a drain.

In FIG. 9, a drainage portion 27 is sealed into the roof in a manner as described hereinbefore, the draingage portion 27 having lips 28 which drain into an existing drain of the building. The drain is thus an integral drain of the roof.

Whilst the arrangement shown in FIGS. 6 to 9 have an insulating layer between the strips and the decking of the building, it is to be appreciated that this layer could be omitted in a cold roof arrangement.

Figure 10:
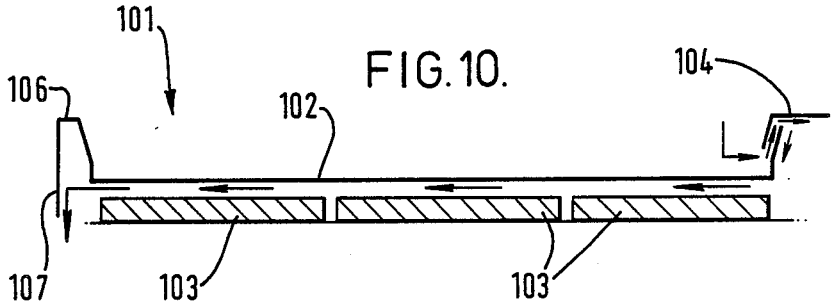
FIG. 10 illustrates a section through a flat roof according to the third aspect of the present invention.

With regard to FIG. 10, a flat roof 101 is provided with a panel of fibreglass material 102. The panel of fibreglass 102 lies above an insulating layer 103. The insulating layer 103 comprises a plurality of spaced apart insulating boards. The insulating boards 103 which are supported on a sub-structure (not shown) may be spaced at 6mm intervals. The panel of fibreglass 102 is constructed to cooperate with existing features of the roof. Thus, for example, an existing flashing 104 of the roof cooperates with a rim 105 of the panel. A small gap may be left between the flashing 104 and the rim 105 to allow air to pass into the space between the panel 102 and the insulating layer 103. Thus, as the panel 102 expands in hot weather, the panel 102 forms a dome, with air being sucked in through the gap between the flashing 104 and the rim 105. The flow of air acts to prevent any build up of condensation or moisture in the space between the panel 102 and the sub-structure (not shown). Around the periphery of the panel 102, a rim 106 is provided; this rim 106 has a downwardly extending portion 107 which may be secured to the sub-structure (not shown).

Figure 11:
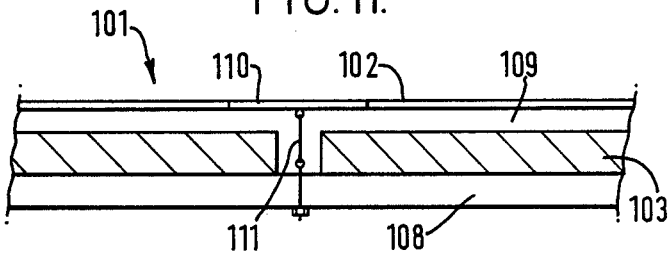
FIG. 11 illustrates a section through a flat roof according to the third aspect of the present invention also including a restraining means.

With regard to FIG. 11, the sub-structure 108 is shown. The insulating boards 103 rest upon the sub-structure 108 and the panel of fibreglass 102 is, in this embodiment, slightly spaced from the insulating board leaving an air passage 109. Into the panel 102, there is cast a steel plate 110. The steel plate 110 is secured to the sub-structure by means of a rubber restraint 111 which permits but generally counters any uplift, due to expansion, of the panel of fibreglass 102.

Figure 12:
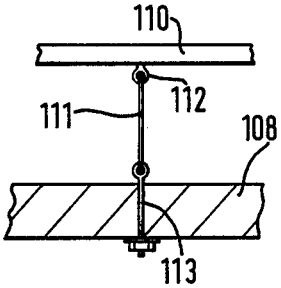
FIG. 12 shows a detailed view of the restraining means as illustrated in FIG. 11.

FIG. 12 shows the rubber restraint 111 in more detail. As illustrated in FIG. 12, the steel plate 110 has, welded therein, an eye 112. The sub-structure 108 has a ring bolt 113 which is bolted through the sub-structure in this embodiment but which, in another embodiment, may be screwed into the sub-structure. The rubber restraint 111 which acts as a "shock cord" connects the steel plate and the sub-structure.

A large roof which is constructed from a number of fibreglass sheets joined together can be envisaged. In order to prevent such a roof from doming, several restraining means as illustrated in FIGS. 11 and 12 may be provided at spaced apart intervals inward of the periphery of the panel of fibreglass material. This allows the expansion to be spread over the entire panel of fibreglass material so that, rather than the whole panel forming a single large dome, the whole panel rises by a small, less significant, amount.

Experiments conducted on a single 8×4 ft. sheet of fibreglass show that increasing the temperature of the sheet from room temperature to 200° F. (93° C.) causes the centre of the sheet to rise 1 inch (25 mm) if the periphery of the sheet is secured. It can be appreciated that a single panel of much greater size as a roof panel would rise a significant amount were it not for the provision of the restraining means.

We claim:

1. A roof, or a portion of a roof, resiliently securable to a substructure of a building, the roof or roof portion comprising:

a panel;

a strip which is overlapped by and supports the panel along at least a portion of the edge regions thereof;

respective fixing means, each extending through a respective aperture in the panel and a corresponding respective aperture in the strip to secure the roof, or the roof portion, to the substructure of the building whilst permitting relative movement between the panel, strip and substructure;

an intermediate layer of a resilient sealing material which spaces the panel from the strip such that the panel is capable of relative movement with respect to the strip whilst sealing the panel with respect to the strip, the resilient sealing material being chosen from those materials which are liquid before assembly of the roof and which are capable of setting, after assembly of the roof, to provide the intermediate layer;

an array of said panels, each panel being resiliently secured to an adjacent panel of the array along their adjacent edge regions;

at least one strip which is overlapped by, and is fixed to, said adjacent edge regions to secure the adjacent panels together;

a plurality of fixing means, each extending through a respective aperture in the panel and a corresponding respective aperture in the strip to secure the roof, or the roof portion, to the substructure of the building whilst permitting relative movement between the panels, the at least one strip and substructure;

wherein the at least one strip, the edge regions of the panels which overlap the at least one strip, and adjacent edges of the panel are spaced-apart by an intermediate layer of a resilient sealing material, the resilient sealing material being chosen from those materials which are liquid before assembly of the roof and which are capable of setting, after assembly of the roof, to provide the intermediate layer; and wherein the panels are capable of relative movement with respect to each other and with respect to the at least one strip, whilst a seal is provided between those components between which there may be relative movement, and wherein a sleeve is aligned in the said apertures and each fixing means extends through a respective sleeve.

2. A roof, or a portion of a roof, according to claim 1, wherein a substantial portion of the outer diameter of the fixing means is less than the inner diameter of the sleeve.

3. A roof, or a portion of a roof, according to claim 2, wherein the outer diameter of the sleeve is less than the inner diameter of the said apertures.

4. A roof, or a portion of a roof, according to claim 1, wherein the intermediate layer of resilient sealing material is a rubber sealant.

5. A roof, or a portion of a roof, according to claim 1, further including at least one elastic restraining means inward of the periphery of one or more, or all of the panels and connecting the sub-structure and the panel.

* * * * *